United States Patent [19]

Imaizumi et al.

[11] 4,077,712

[45] Mar. 7, 1978

[54] WET TYPE DEVELOPING DEVICE FOR USE IN ELECTROPHOTOGRAPHY

[75] Inventors: Koji Imaizumi, Aichiken; Shigemitsu Shimizu, Toyokawa, both of Japan

[73] Assignee: Minolta Camera Kabushiki Kaisha, Azuchi, Japan

[21] Appl. No.: 634,328

[22] Filed: Nov. 21, 1975

[30] Foreign Application Priority Data

Dec. 3, 1974 Japan ..... 49-147102[U]

[51] Int. Cl.[2] ..... G03G 15/10

[52] U.S. Cl. ..... 355/10; 427/15

[58] Field of Search ..... 355/10, 27, 28, 100, 355/106; 118/637, 651, 648, 662; 427/14–17; 259/4 R; 354/328–330

[56] References Cited

U.S. PATENT DOCUMENTS

| | | | |
|---|---|---|---|
| 2,128,921 | 9/1938 | Draeger | 354/328 X |
| 3,392,708 | 7/1968 | Hunstiger | 427/15 X |
| 3,808,025 | 4/1974 | Fukushima et al. | 355/10 X |

*Primary Examiner*—A. D. Pellinen

*Attorney, Agent, or Firm*—Wenderoth, Lind & Ponack

[57] ABSTRACT

A developing device employing developing solution for use in an electrophotographic copying apparatus, which developing device includes a pair of stirring impellers rotatably disposed at the bottom of a developing tank and a plurality of pairs of copy paper feeding and electrode rollers immersed in the developing solution above the impellers, with one of the roller pairs being associated for simultaneous rotation with the impellers for efficient circulation of the developing solution, and for rapid and uniform dispersion of toner particles in the developing solution.

10 Claims, 6 Drawing Figures

WET TYPE DEVELOPING DEVICE FOR USE IN ELECTROPHOTOGRAPHY

The present invention relates to a developing device for use in an electrophotographic copying apparatus of the wet developing type and more particularly, to a developing device employing developing solution and having optimum response to electrical charge of comparatively low potential, especially as in the charge of an electrostatic latent image formed on transfer material through an electrostatic transfer method.

BACKGROUND OF THE INVENTION

Commonly, in an electrophotographic copying apparatus of the wet developing type, photosensitive material or copy paper, for example, wound on a rotatable spool is fed, by a plurality of rollers, into a developing device which contains therein an organic developing solution including toner particles for developing an electrostatic latent image of an original formed on the surface of the copy paper into visible toner image, through processing devices such as a copy paper cutting device, a corona charging device, an exposure device and the like disposed along a path of the copy paper in a known manner.

There has conventionally been proposed a developing device employing the developing solution for use in the so-called electrofax type copying apparatus in Japanese Utility Model Publication Jitsukaisho 47/25039. That device includes a plurality of impellers each having a plurality of blades rotatably disposed in a developing tank for stirring the developing solution contained therein, and means for transmitting rotation of a copy paper transporting mechanism of the copying apparatus to the stirring impellers so that the impellers are rotated simultaneously with the rotation of the copy paper transporting mechanism. The device is so constructed that the stirring impellers are fixedly mounted at regular intervals on a rotatable shaft directed at right angles to the direction of advance of the copy paper for feeding part of the developing solution being stirred toward the copy paper sheet. By this arrangement, however, it is impossible to stir or agitate the toner particles settled at the bottom of the developing tank, especially at the portion immediately below a developing electrode in a short period of time, for example, within several seconds.

Another conventional developing device of similar purpose also for use in the electrofax type copying apparatus disclosed in Japanese Utility Model Publication Jitsukaisho 50/10243 includes a guide plate provided to form a developing passage for copy paper in a developing tank in such a manner that at least part of the developing passage is located below the predetermined level of the developing solution contained in the developing tank; a driving shaft rotatably and horizontally disposed in the developing tank; and a plurality of stirring vanes each having a plurality of blades and disposed below the predetermined level of the developing solution adjacent to the bottom of the developing tank. The stirring vanes are engaged for rotation with the driving shaft which is associated with a copy paper transportation mechanism of the copying apparatus. That arrangement, however, is also incapable of agitating toner particles settled below a developing electrode in a short period of time, since the stirring vanes disposed adjacent to the developing tank are located away from the position immediately below the developing electrode.

In other words, although both of the above prior art developing devices of Japanese Utility Model Publication of Jitsukaisho 47/25039 and Jitsukaisho 50/10243 aim at driving the stirring rotary members through the copy paper transportation mechanism, nothing is taken into account concerning the rapid stirring of the toner particles settled below the developing electrode, and the essential purpose of stirring for uniformly distributing toner particles within the developing tank can not be achieved due to merely local circulation of the developing solution or only limited amount of the same solution moving within the tank.

Furthermore, it should be noted that the wet developing in the electrophotography is based on the principle that charged toner particles within the organic solvent are attracted by the electric field of the electrostatic latent image formed on the copy paper, move toward the latent image through electrophoresis and consequently adhere to the surface of the latent image by the coulomb force. In the electrophotographic copying apparatus, the amount of toner particles which stick, within a limited period of time, to the surface of the copy paper passing through the developing solution, or developing density depends on the rate of movement of toner particles, i.e., the number of toner particles reaching the latent image on the surface of the copy paper within the developing solution. The larger the amount of charge of the toner particles and also the electric field strength due to charge of the latent image are, the higher is the developing density within a limited period of time. In that case, the field strength varies to a great extent not only with the surface potential of the latent image on the copy paper, but also with the distance between the charge of the latent image on the copy paper and the developing electrode opposed thereto. Such an effect is particularly conspicuous with respect to a latent image having a spreading area.

On the other hand, in the electrophotographic copying apparatus of the latent image transfer type wherein a latent image once formed on a photoreceptor surface is transferred onto a copy paper sheet, even when a latent image having a high potential (for example, in the vicinity of 1000 volts) can be formed on the photoreceptor surface, the potential of the latent image, when transferred onto the copy paper, is reduced to approximately 1/10 of the latent image on the photoreceptor, i.e., to a low potential ordinarily in the order of 100 to 150 volts.

Accordingly, when the wet developing devices designed for use in the conventional electrophotographic copying apparatus of the electrofax type, wherein a latent image of high potential in the range of 300 to 400 volts is directly formed on the photosensitive copy paper for development by such wet developing devices as those disclosed in the Japanese Utility Model Publications Jitsukaisho 47/25039 and Jitsukaisho 50/10243, are employed for the latent image of low potential as in the above described copying apparatus of latent image transfer type using the photoreceptor, the resultant developed image is so weak in density that the same hardly meets the practical purpose.

A wet developing device having satisfactory response to charge is therefore required for developing the copy paper having a low potential charge. More specifically, in order to obtain copied images of sufficient developing density from the latent image having low potential in the region of 100 volts as described above, developing solution which employs toner particles with a small amount of charge corresponding to the charge of the latent image should be adopted. At the same time, the ratio of the toner particles in such a developing solution must be increased, for example, up to approximately 30%, which is the equivalent to approximately 4 to 6 times the ratio of toner particles in the developing solution employed in the conventional developing devices for use in the copying apparatus of the electrofax type. On the other hand, the developing electrode plate employed in the conventional copying apparatus of the electrofax type is not suitable for the above purpose, since in such prior art electrode plates, the distance between the copy paper surface and the electrode plate is too large with the slow moving rate of toner particles. This results in insufficient developing density, from which fact, employment of a pair of electrode rollers of metallic material suitably grounded and adapted to rotate in direct contact with the latent-image-formed surface of the copy paper is required for reducing the distance between the electrode and the latent image and, thus, for fully increasing the field strength. Even in the above arrangement, however, since the contact between the electrode roller and the copy paper is nearly linear contact, the region having high field strength is limited to a small portion in the vicinity where the electrode rollers immediately contact the copy paper, and consequently, the time required for the copy paper to pass such a small portion between the pair of electrode rollers tends to be reduced as compared with that required in the conventional devices employing the electrode plate. These drawbacks may be overcome by providing a plurality of pairs of electrode rollers, preferably more than three pairs, together with the marked increase of the field strength in the above described manner.

Accordingly, it is desirable that a developing device using developing solution of high toner concentration, with a plurality of electrode rollers provided therein should be employed as a wet developing device for developing the copy paper bearing thereon the electrostatic latent image of low potential. Such a wet developing device, however, still has such disadvantages that, because of the high toner powder content in the developing solution, the toner particles are likely to settle on the bottom of the developing tank and make it impossible to obtain definite copied images having the proper density. Without rectification of which defects, a wet developing device actually suitable for practical use can not be presented.

From the foregoing description it is clear that in the wet developing device especially for use in the electrophotographic copying apparatus of the latent image transfer type, the toner particles tend to settle very easily in comparison to the device employed in the copying apparatus of the electrofax type, for which tendency an effective counter-measure must be introduced.

BRIEF SUMMARY OF THE INVENTION

Accordingly, an essential object of the present invention is to provide a developing device employing developing solution for use in an electrophotographic copying apparatus which is capable of stirring the toner particles settled on an entire bottom portion of a developing tank, at least below a developing electrode, within a short period of time.

Another important object of the present invention is to provide a developing device of the above described type which is capable of rapidly distributing a uniform concentration of the developing solution within the developing tank, even when concentrated developing solution is supplied into the developing device from one side of the developing tank.

A further object of the present invention is to provide a developing device of the above described type which is simple in construction and accurate in functioning.

A still further object of the present invention is to provide a developing device which is applicable to electrophotographic copying apparatuses of both the latent image transfer type and the electrofax type.

According to a preferred embodiment of the present invention, the wet type developing device includes a developing tank for receiving developing solution therein; a pair of stirring impellers rotatably mounted, in spaced relation to each other, at the bottom portion of the developing tank and having a plurality of ribs, blades and also notches formed in the outer peripheral edges of the impellers — one side of each of the ribs cut slantwise to form a predetermined angle with respect to the plane normal to the axis of each impeller; a partition plate of approximately S-shaped cross section disposed on the bottom plate of the tank between the impellers; and a plurality of pairs of copy paper feeding and electrode rollers immersed in the developing solution and rotatably disposed above the impellers, one of the lower rollers of the roller pairs having pin wheels secured at opposite end thereof, which pin wheels engage the notches formed in the peripheral edges of the impellers for rotating the impellers simultaneously with the rotation of the roller pairs. By this arrangement, the developing solution is fully circulated within the developing tank forms a path of flow in the shape of letter S. The same solution is, thus, transferred upward from under the rotating impellers by the presence of the ribs having inclined side edges, and the disadvantages inherent in the conventional developing devices are advantageously eliminated.

BRIEF DESCRIPTION OF THE DRAWINGS

These and other objects and features of the present invention will become apparent from the following description taken in conjunction with the preferred embodiment thereof with reference to the attached drawings, in which.

Before the description of the present invention proceeds, it is to be noted that like parts are designated by like reference numerals throughout several views of the attached drawings.

DETAILED DESCRIPTION OF THE INVENTION

Referring now to FIG. 1 to 5, there is shown a wet type developing device D of the invention. This includes a developing tank 1 of generally rectangular cubic configuration open at its top and having a front side wall 1*a*, a rear side wall 1*b*, side walls 1*c* and a bottom wall 1*d* for receiving developing solution D*s* therein. A pair of stirring impeller members 2 and 2′ are rotatably mounted, in spaced relation to each other, on corresponding shafts 3 and 3′ secured to the bottom wall 1*d*, and pairs of rollers *r*1 and *r*1′, *r*2 and *r*2′, *r*3 and *r*3′, and *r*4 and *r*4′ are provided for copy paper feeding. Each pair of rollers is generally immersed in the developing solution D*s* and is rotatably supported along the path of copy paper by a pair of support plates *p*1 and *p*2 which extend upwardly at right angles from the bottom wall 1*d* within the developing tank 1 in positions adjacent and parallel to the side walls 1*c*. A toner tank T is secured to the upper portion of the partition plate *p*2 for replenishing the developing solution with fresh toner. Each of the stirring impellers 2 and 2′ generally comprises a concentric hub portion 2*a*, an inner rim 2*b*, an outer rim 2*c* and a disc portion 2*d* extending outwardly from the outer rim 2*c* and having a plurality of notches *n* formed in the peripheral edge thereof. The hub 2*a* is connected to the inner rim 2*b* through a plurality of ribs *m* radially outwardly extending from the hub 2*a*, and the inner rim 2*b* is integrally connected to the outer rim 2*c* by a plurality of blades *b* also radially outwardly extending from the inner rim 2*b*.

Figure 4:
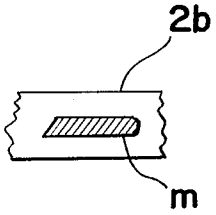
FIG. 4 is a sectional view, on an enlarged scale and partly broken away, taken along the line IV — IV of FIG. 3.
Figure 5:
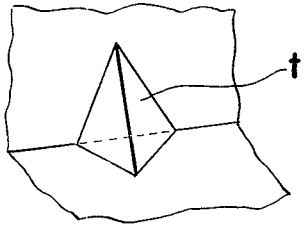
FIG. 5 is a perspective view, partly broken away, of a toner settling prevention member of FIG. 3.

As is seen from FIG. 4, each of the ribs *m* disposed in a direction normal to the axis of the impeller has approximately a rectangular cross section, with one short side thereof inclined or cut slantwise to make an angle, preferably of 45° to its long side and with the other short side thereof slightly rounded. Because of this angle, during rotation of the impellers 2 and 2′, the developing solution is caused to flow efficiently from under each of the impellers 2 and 2′ onto the upper portion thereof, while being sufficiently agitated by the blades *b*.

Figure 1:
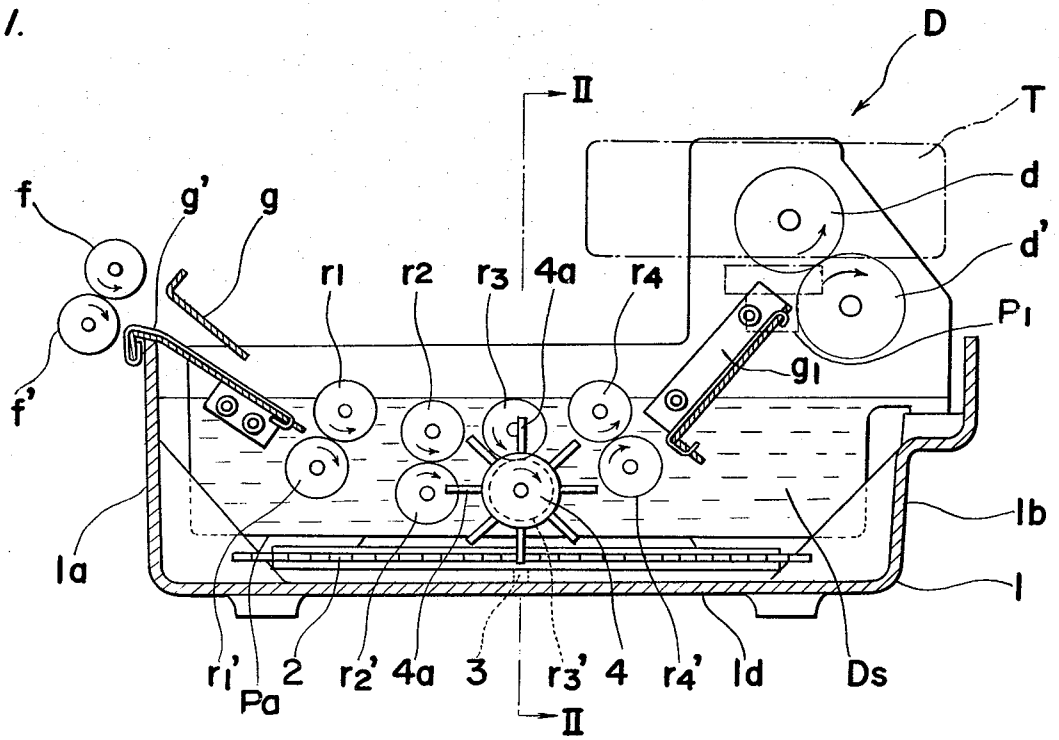
FIG. 1 is a schematic side sectional view of a developing device of the invention.
Figure 2:
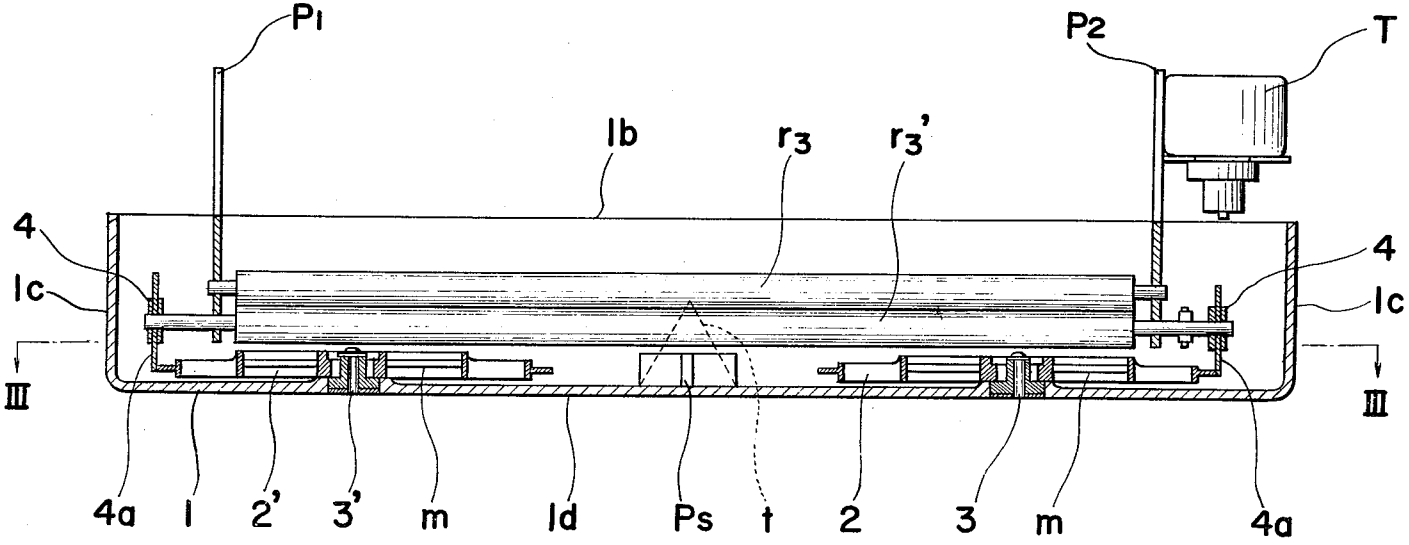
FIG. 2 is a sectional view taken along the line II — II of FIG. 1.
Figure 3:
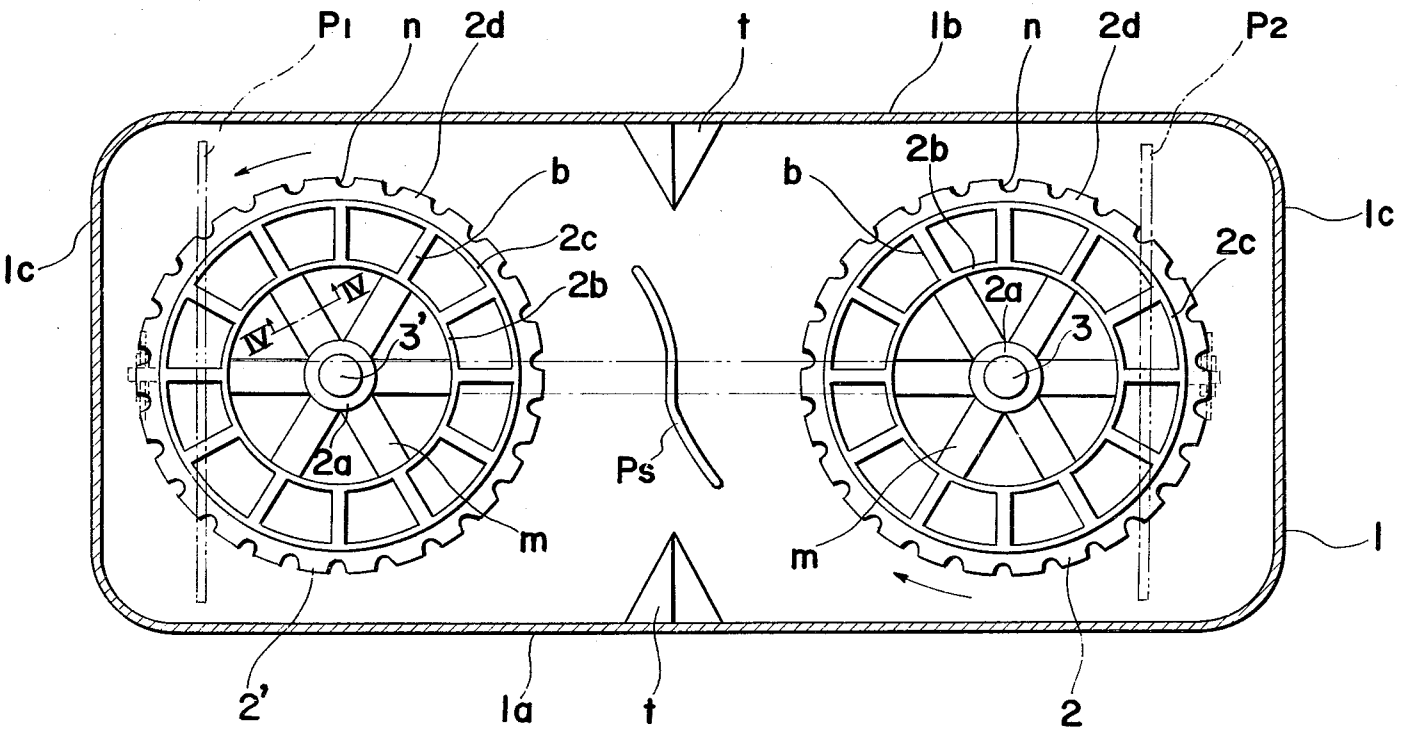
FIG. 3 is a sectional view taken along the line III — III of FIG. 2.

Referring particularly to FIGS. 1 to 3, the upper rollers *r*1 to *r*4 of the roller pairs *r*1 and *r*1′ to *r*4 to *r*4′ are electrode rollers which are short-circuited through the support plates P1 and P2 for developing an electrostatic latent image of an original formed on the copy paper. The lower rollers *r*1′ to *r*4′ are also of metallic material. At the opposite ends of the lower roller *r*3′, pin gears or pin wheels 4 having a plurality of radially outwardly extending pins 4*a* are mounted and adapted to engage the notches *n* at the outer edges of the impeller members 2 and 2′ for rotating said impeller members. The lower portions of the support plates *p*1 and *p*2 are formed with cut out portions *pa* for admitting part of the outer periphery of each of the impellers 2 and 2′ to allow free rotation of the same. On the bottom wall 1*d* in a position between the impellers 2 and 2′, there is fixedly disposed a partition plate P*s* of approximately S-shaped cross section and toner settling prevention members *t* of tetrahedron shape are secured to the corners defined by the front and rear side walls 1*a* and 1*b* and the bottom wall 1*d* in positions adjacent to opposite ends of the partition plate P*s*. It should be noted that the partition plate P*s* has approximately an S-shaped cross-section for attaining optimum stirring and circulation of the developing solution without any obstruction and for efficiently directing the developing solution toward the electrode rollers *r*1 to *r*4. The length of the partition plate p*s* should preferably be approximately such that the same is equivalent to ⅛ of one rotation of each of the impeller members 2 and 2′.

It should also be noted that the toner settling prevention members *t* are arranged to be higher than the partition plate P*s* and the stirring impeller members 2 and 2′. This blocks the corners facing the partition plate P*s* where the developing solution tends to stagnate at the bottom of the toner tank 1 due to insufficient agitation even by the rotation of the impeller members 2 and 2′, thus causing the toner to readily settle.

Needless to say, the toner settling prevention members *t* described as formed by separate members in the above embodiment may be integrally formed with the front and rear side walls 1*a* and 1*c* and the bottom wall 1*d*, for example, by press work.

Figure 6:
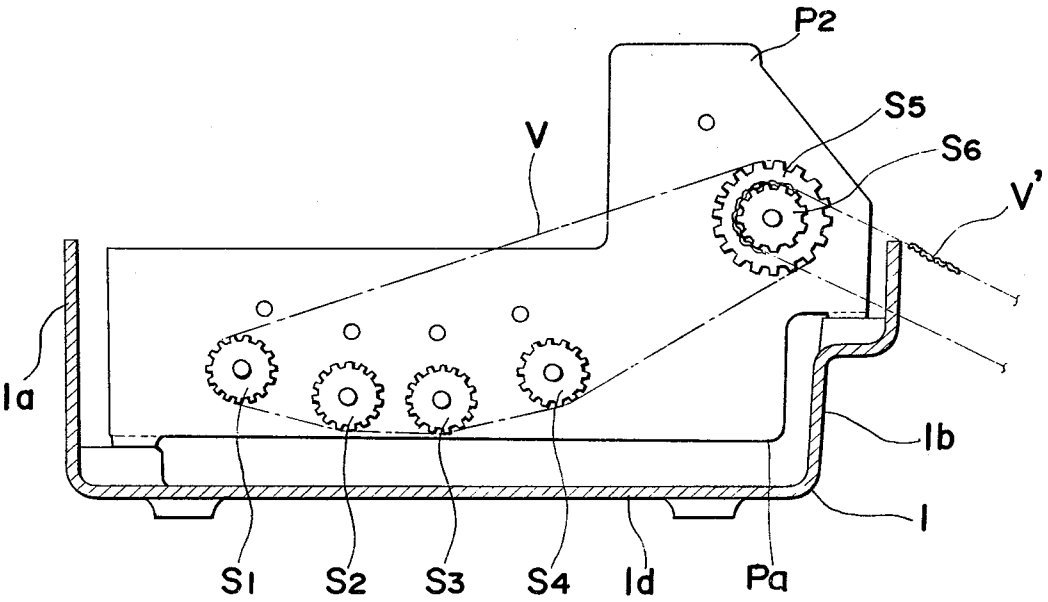
FIG. 6 is a similar view to FIG. 1, but particularly shows driving mechanisms thereof.

Referring to FIG. 6, sprockets S1 to S4 secured to shafts of the lower roller *r*1′ to *r*4′ respectively are connected, through a timing belt V, to a sprocket S5 fixedly mounted to a shaft of the lower roller *d*′ of a pair of squeezing rollers *d* and *d*′ which are also rotatably supported by the support plates *p*1 and *p*2. Another sprocket S6 secured to the same shaft for the roller *d*′ as the sprocket S5 is connected to a driving shaft of a motor (not shown) through a chain V′ upon energization of the motor (not shown), the rotation thereof is transmitted to the sprockets S1 to S4 through the belt V so as to rotate the lower rollers *r*1′ to *r*4′, while the upper electrode rollers *r*1 to *r*4 rotate due to contact with the rollers *r*1′ to *r*4′ by the weight thereof.

In this arrangement, upon rotation of the motor (not shown), the squeezing roller *d*′ is rotated through the chain V′, and the rollers *r*1′ to *r*4′ within the tank 1 constantly rotate in a direction shown by the arrows in FIG. 1 through the belt V. The copy paper (not shown) bearing the electrostatic latent image thereon is introduced into the developing solution D*s* in the tank 1 through a pair of feeding rollers *f* and *f*′ rotatably disposed at the upper portion of the front wall 1*a* of the tank 1, downward through a pair of guide plates *g* and *g*′ (FIG. 1) secured to the partition plates P1 and P2 in a position adjacent to the rollers *f* and *f*′, and then through the roller pairs *r*1 and *r*1′, *r*2 and *r*2′, *r*3 and *r*3′ and *r*4 and *r*4′. The pin wheels 4 secured to the opposite ends of the roller *r*3′ rotate together with the roller *r*3′, and the impeller members 2 and 2′ simultaneously rotate in the directions shown by arrows in FIG. 3. These impeller members 2 and 2′ mesh, at the notches *n* thereof, with the pin wheels 4. In the arrangement as shown in the above embodiment of FIGS. 1 to 6, the impeller members 2 and 2′ necessarily rotate in the opposite direction to each other, and in FIG. 3 the developing solution D*s* within the tank 1 moves from the right-hand side toward the left along the partition plate P*s* through clockwise rotation of the impeller member 2. The same solution D*s* also moves toward the right-hand side through counterclockwise rotation of the impeller member 2′ over the partition plate P*s*. Thus, the flow of the developing solution D*s* caused by the impeller member 2′ joins the flow of the same by the impeller member 2 to form a circulation of the developing solution D*s* in the form of letters S for supplying fully stirred developing solution toward the upper electrode rollers *r*1 to *r*4. The ribs *m* having the inclined side edges earlier mentioned serve to cause the developing solution D*s* to move upward from under the impeller members 2 and 2' to efficiently circulate the developing solution and rapidly disperse the toner particles even when the fresh toner is supplied into the tank 1 from the toner tank T. After being developed in the tank 1 by the fully stirred developing solution as described above, the copy paper (not shown) is directed between the squeezing rollers *d* and *d'* through a guide plate *g*1 (FIG. 1) secured to the partition plates *p*1 and *p*2 for further being fed into subsequent processing devices such as a fixing device (not shown).

It should be noted here that, in a developing tank whose top plan view is rectangular as is the tank 1 of FIG. 3, the pair of stirring impeller members 2 and 2' rotating in directions opposite to each other are necessary for effectively circulating the developing solution thoroughly within the tank 1 and also for rapidly and uniformly dispersing the toner supplied into the tank 1 through the circulation of the developing solution in the shape of the letter S while being advantageously assisted by the provision of the partition plate P*s*. However, in a developing tank having an approximately square configuration as viewed from the top, one impeller member is sufficient, and the partition plate P*s* may be dispensed with. Then, the developing solution simply flows in a circular path.

It should also be noted that the pin wheels 4 secured to the opposite ends of the roller *r*3' and the notches *n* formed in the peripheral edge of the disc portion 2*d* of each of the impellers 2 and 2' (described as employed in the above embodiment for transmitting the rotation of the roller *r*3' to the impellers 2 and 2') may be replaced by any other transmission means such as bevel gears and the like so long as such means is capable of changing directions of axes of rotation.

As is clear from the foregoing description, according to the developing device of the invention, not only is the developing solution having uniform toner dispersion therein efficiently circulated throughout the developing tank, but fresh toner supplied to the developing solution is also rapidly and uniformly dispersed within the developing tank. The disadvantages inherent in the conventional developing devices are substantially eliminated.

The provision of the ribs *m* having inclined edges, the partition plate P*s* between the stirring impellers and the toner settling prevention members *t* at the corners opposite to the ends of the plate P*a* are particularly effective for achieving optimum stirring and circulation of the developing solution within the developing tank (without any settling of the toner particles to the bottom portion of the developing tank) and these same features also positively direct the flow of the developing solution toward the electrode rollers to obtain clear and definite copied images without any defects such as unevenness, insufficient density and the like.

It is another advantage of the developing device of the invention that the construction of the mechanism for transmitting the rotation of the feeding roller to the impellers remains quite simple. It requires no intermediate members such as gears, separate driving shafts, sprockets, chains and the like, as in the conventional developing devices, because it employs the developing electrode in the form of rollers as has the impeller members disposed below said electrode rollers.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A wet-type electrophotographic developing device for developing an electrostatic latent image on a copy material in a wet developing solution containing toner particles comprising:

a developing tank containing said developing solution therein;

at least one pair of rotatable roller means having a shaft therethrough positioned in said developing tank in said developing solution for contacting and passing said copy material therebetween through said developing solution in said tank and for developing said image on said copy material;

at least one substantially horizontal stirring member in said developing tank adjacent the bottom of said tank beneath said roller means for agitating said developing solution and toner particles in the bottom of said tank at least beneath said roller means; and at least one pair of engaging members mounted on said shaft through said roller means engaging said stirring member, whereby said stirring member moves in conjunction with the rotation of said shaft through said roller means.

2. A device as claimed in claim 1, wherein said roller means is comprised of:

at least one rotatable developing electrode roller means contacting the image side of said copy material for developing the image of said copy material, and at least one copy material feed roller means having a rotatable shaft therethrough in contact with the side of said copy material opposite said image side contacting said electrode roller means for rotating said electrode roller means due to contact therewith through said copy material and for forming a developing electrode portion at the contact point with said developing electrode roller means.

3. A device as claimed in claim 2, wherein said horizontal stirring member is comprised of a stirring impeller having notched portions around the circumference thereof.

4. A device as claimed in claim 3, wherein said engaging members are comprised of gear members operatively connected to and rotatable with said shaft through at least one of said copy material feed roller means and further engage said notches in said stirring impeller, whereby rotation of said copy material feed roller means causes said engaging members and said stirring impeller to rotate.

5. A device as claimed in claim 3, wherein said stirring impeller has a plurality of angled rib members shaped to cause said developing solution therebeneath to flow upward toward said roller means thereabove during rotation of said stirring impeller.

6. A device as claimed in claim 3, wherein a plurality of rotatable horizontal stirring impellers are horizontally spaced from each other above the bottom of said developing tank beneath said roller means, said impellers engaging said engaging members; and further comprising an approximately S-shaped partition means fixed between said spaced impellers for directing said developing solution agitated by said impellers toward said roller means.

7. A device as claimed in claim 6, further comprising toner settling prevention members positioned within said developing tank at the intersection of the sidewalls and bottom of said tank at the opposite ends of said partition means.

8. A wet-type electrophotographic developing device for developing an electrostatic latent image on a copy material in a wet developing solution comprising:

a developing tank containing said developing solution therein;

paired rotatable roller means positioned in said developing tank in said developing solution for contacting and passing said copy material therebetween through said developing solution in said tank and for developing said image on said copy material, said roller means being comprised of:

at least one rotatable developing electrode roller means contacting the image side of said copy material for developing the image on said copy material, and at least one copy material feed roller means in contact with the side of said copy material opposite said image side contacting said electrode roller means for rotating said electrode roller means due to contact therewith through said copy material and for forming a developing electrode portion at the contact point with said developing electrode roller means;

substantially horizontal stirring means in said developing tank adjacent the bottom of said tank and beneath said roller means for agitating said developing solution in the bottom of said tank at least beneath said roller means, said stirring means being comprised of:

at least one horizontal rotatable stirring impeller spaced from the bottom of said developing tank beneath said roller means, said impeller having notched portions around the circumference thereof; and engaging means connected to said roller means and engaging said stirring means for operating said stirring means in conjunction with the rotation of said roller means, said engaging means being comprised of at least one gear member operatively connected to and rotatable with at least one of said copy material feed roller means and further engages said notches in said stirring impeller, whereby rotation of said copy material feed roller means causes said engaging means and said stirring means to rotate.

9. A wet-type electrophotographic developing device for developing an electrostatic latent image on a copy material in a wet developing solution comprising:

a developing tank containing said developing solution therein;

paired rotation roller means positioned in said developing tank in said developing solution for contacting and passing said copy material therebetween through said developing solution in said tank and for developing said image on said copy material;

substantially horizontal stirring means in said developing tank adjacent the bottom of said tank and beneath said roller means for agitating said developing solution in the bottom of said tank at least beneath said roller means, said stirring means being comprised of a plurality of horizontal rotatable stirring impellers horizontally spaced from each other above bottom of said developing tank beneath said roller means;

an approximately S-shaped partition means fixed between said spaced impellers for directing said developing solution agitated by said impellers toward said roller means; and engaging means connected to said roller means and engaging said stirring means for operating said stirring means in conjunction with the rotation of said roller means.

10. A device as claimed in claim 9, further comprising toner settling prevention members positioned within said developing tank at the intersection of the sidewalls and bottom of said tank at the opposite ends of said partition means.

* * * * *